US009645590B1

(12) United States Patent
Fung et al.

(10) Patent No.: US 9,645,590 B1
(45) Date of Patent: May 9, 2017

(54) SYSTEM FOR PROVIDING ON-CHIP VOLTAGE SUPPLY FOR DISTRIBUTED LOADS

(71) Applicant: Solomon Systech Limited, Hong Kong (HK)

(72) Inventors: Hiu Siu Bernard Fung, Hong Kong (HK); Hok Sun Ling, Hong Kong (HK)

(73) Assignee: Solomon Systech Limited, Hong Kong (HK)

( * ) Notice: Subject to any disclaimer, the term of this patent is extended or adjusted under 35 U.S.C. 154(b) by 0 days.

(21) Appl. No.: 15/006,138

(22) Filed: Jan. 26, 2016

(51) Int. Cl.
*G05F 1/10* (2006.01)
*G05F 1/46* (2006.01)
*G05F 1/575* (2006.01)

(52) U.S. Cl.
CPC ..... *G05F 1/468* (2013.01); *G05F 1/575* (2013.01)

(58) Field of Classification Search
CPC . G05F 1/59; G05F 1/613; G05F 1/614; G05F 1/468; G05F 1/575
See application file for complete search history.

(56) References Cited

U.S. PATENT DOCUMENTS 6,130,635 A * 10/2000 Jones, III ..... H03M 1/06 341/154
6,674,274 B2 * 1/2004 Hobrecht ..... H02J 1/102 323/268
6,806,690 B2 * 10/2004 Xi ..... G05F 1/575 323/273
6,965,218 B2 * 11/2005 Scoones ..... G05F 1/56 323/274
7,482,791 B2 * 1/2009 Stoichita ..... H02M 3/156 323/271
7,492,132 B2 * 2/2009 Kuroiwa ..... H02M 3/156 323/222
7,541,786 B2 * 6/2009 Yen ..... G05F 1/46 323/275
8,148,850 B2 * 4/2012 Bonnet ..... H02J 1/102 307/82
8,841,893 B2 * 9/2014 Bulzacchelli ..... G05F 1/575 323/280

(Continued)

OTHER PUBLICATIONS

F. Lima et al., Embedded CMOS Distributed Voltage Regulator for Large Core Loads, ESSCIRC'03, 29th European Solid-State Circuits Conference.

*Primary Examiner* — Thomas J Hiltunen

(57) ABSTRACT

A system for providing on-chip voltage supply includes a plurality of local voltage regulators each including a first input, a second input, and an output; a transconductance amplifier connected with the local voltage regulators and configured to drive the local voltage regulators, including a first input, a second input and an output; a reference voltage source; and a plurality of transistors. The output of the transconductance amplifier is connected to the first input of each local voltage regulators. The first input of each local voltage regulator is connected to ground through a first capacitor. The output of each local voltage regulator is connected to gate of each transistor correspondingly. Source or drain of each transistor is connected to a load, to the second input of the local voltage regulator, to each other through a plurality of first resistors representing metal routing resistance, and to ground through a RC network.

10 Claims, 9 Drawing Sheets

(56) References Cited

U.S. PATENT DOCUMENTS

| | | | | |
|---|---|---|---|---|
| 8,854,023 | B2 * | 10/2014 | Ock | G05F 1/56 323/275 |
| 9,213,382 | B2 * | 12/2015 | Paillet | G06F 1/26 |
| 9,342,087 | B2 * | 5/2016 | Chen | G05F 1/56 |
| 2009/0051418 | A1 | 2/2009 | Gogl | |
| 2010/0264888 | A1 * | 10/2010 | Wada | G05F 1/59 323/274 |
| 2015/0028835 | A1 * | 1/2015 | Kim | G05F 1/56 323/280 |
| 2016/0164414 | A1 * | 6/2016 | Hang | H02M 3/1584 323/271 |

* cited by examiner

SYSTEM FOR PROVIDING ON-CHIP VOLTAGE SUPPLY FOR DISTRIBUTED LOADS

FIELD OF THE PATENT APPLICATION

The present patent application generally relates to integrated circuits and more specifically to a system for providing on-chip fast response voltage supply for distributed loads.

BACKGROUND

In mobile display products, the power-hunger digital core together with its lengthy strip-shaped layout orientation places stringent requirements on on-chip voltage supply rail design. The highly resistive ITOs of display driver application circuit tend to disable the effectiveness of external output capacitor for decoupling load transient. In addition, each regulator in the conventional distributed architecture introduces offset behavior due to different layout locations, which will inherit long transient response time from light to heavy loading.

FIG. 1 illustrates an electronic display panel with a conventional system of providing on-chip voltage supply. Referring to FIG. 1, a display driver IC 101 is connected to the electronic display panel 103 to drive the panel displaying images. This connection is often made by Chip-On-Glass (COG) method in mobile devices, such as mobile phones. The driver IC 101 is designed to be long and narrow in order to minimize the display panel size as shown in FIG. 1. A commonly used conducting material on the display glass is Indium Tin Oxide (ITO). ITO can be made into transparent conducting films coating on a glass substrate. ITO is commonly used for displays technologies, such as Liquid Crystal Displays (LCD), Organic Light Emitting Diodes (OLED) displays, as well as in touch panel technologies. But ITO is relatively resistive. The sheet resistance of ITO material is much higher (over 10 times) than metal connections in driver IC.

Referring to FIG. 1, digital core 105 is a collection of digital circuits in the driver IC 101 having the same power supply voltage Vdd. With an external power Vpower 109, a voltage regulator 107 in the driver IC delivers the Vdd voltage for the digital core 105. The Vpower voltage is higher than Vdd. The digital core current consumption in full operation can be several hundred mA, depending on the display panel technology, size and resolution. The VDD current is not steady. When the display is turned from off to on, the VDD current may jump from <0.1 mA up to hundreds of mA in nanoseconds. While the VDD current is fluctuating, the digital core requires a stable supply voltage Vdd in order to operate properly. An external capacitor 111 connecting to VDD via ITO is used to maintain the Vdd stability. As the current consumption increases for larger and higher resolution display panels in modern mobile electronic devices, the high resistance of the ITO connections 113 to the external capacitor 111 reduces the effectiveness in maintaining the Vdd stability. Therefore, a distributed on-chip voltage supply system with ultra-fast response is needed to address the problem.

SUMMARY

The present patent application is directed to a system for providing on-chip voltage supply. The system includes: a plurality of local voltage regulators, each local voltage regulator including a first input, a second input, and an output; a transconductance amplifier connected with the local voltage regulators and configured to drive the local voltage regulators, the transconductance amplifier including a first input, a second input and an output; a reference voltage source; and a plurality of transistors. The output of the transconductance amplifier is connected to the first input of each local voltage regulators. The first input of the transconductance amplifier is connected to the reference voltage source. The first input of each local voltage regulator is connected to ground through a first capacitor. The output of each local voltage regulator is connected to gate of each transistor correspondingly. Source or drain of each transistor is connected to a load, to the second input of the local voltage regulator, to each other through a plurality of first resistors representing metal routing resistance, and to ground through a RC network. A tapping point in the RC network is connected to the second input of the transconductance amplifier.

The load may be a digital core of a driver IC. The RC network may include the first resistors, at least one second resistor representing resistance of ITO connections, and a second capacitor being connected in series. The reference voltage source may be a steady DC voltage source.

The transconductance amplifier may have a voltage gain in the range of 50~90 dB and a bandwidth in the range of 1~4 MHz. Each local voltage regulator may have a voltage gain in the range of 15~18 dB and a bandwidth in the range of 16~38 MHz. The transistors may be PMOS transistors.

The reference voltage source may be configured to make an adjustment to voltage at the first input of the transconductance amplifier so that voltage at the source or the drain of each transistor is increased by a predetermined amount before a predictable current loading jump, and to cancel the adjustment after fluctuation of voltage at the source or the drain of each transistor caused by the adjustment is settled.

BRIEF DESCRIPTIONS OF THE DRAWINGS

DETAILED DESCRIPTION

Reference will now be made in detail to a preferred embodiment of the system for providing on-chip voltage supply for distributed loads disclosed in the present patent application, examples of which are also provided in the following description. Exemplary embodiments of the system for providing on-chip voltage supply for distributed loads disclosed in the present patent application are described in detail, although it will be apparent to those skilled in the relevant art that some features that are not particularly important to an understanding of the system for providing on-chip voltage supply for distributed loads may not be shown for the sake of clarity.

Furthermore, it should be understood that the system for providing on-chip voltage supply for distributed loads disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

Figure 1:
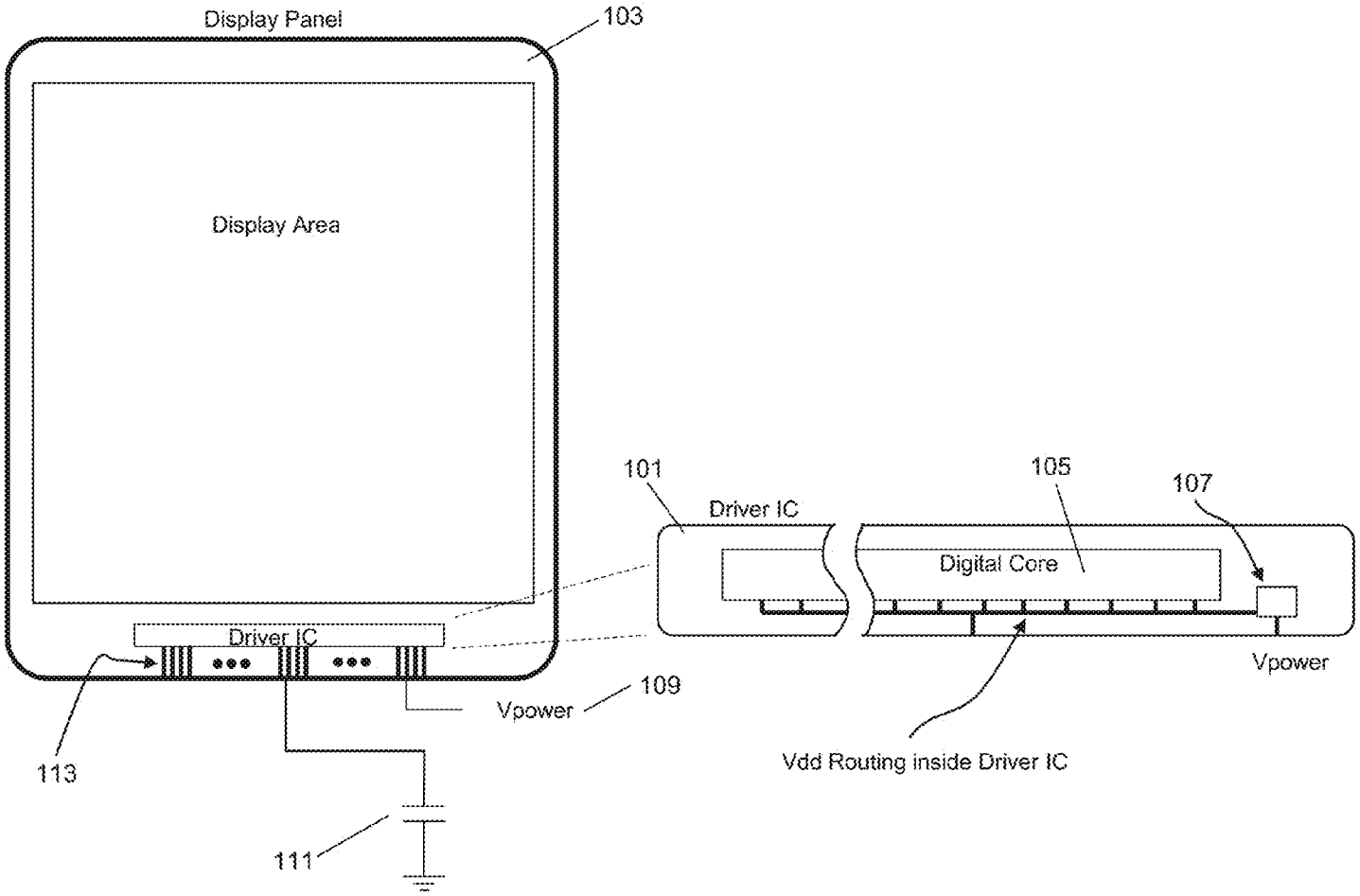
Fig. 1 (Prior Art)
FIG. 1 illustrates an electronic display panel with a conventional system of providing on-chip voltage supply.
Figure 2:
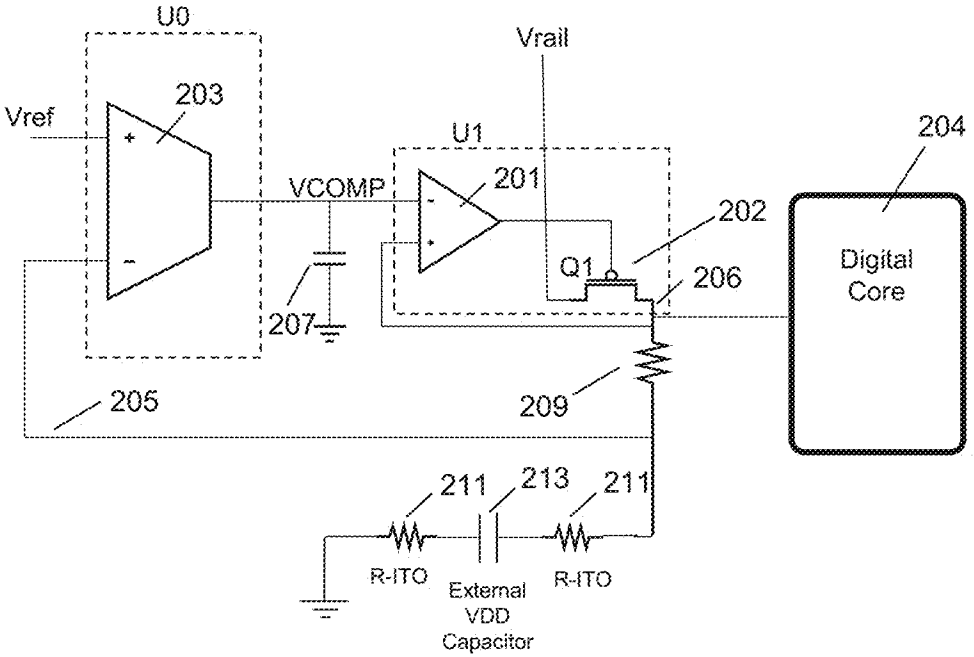
FIG. 2 is a schematic circuit diagram illustrating a system for providing on-chip voltage supply for distributed loads in accordance with an embodiment of the present patent application.

FIG. 2 is a schematic circuit diagram illustrating a system for providing on-chip voltage supply for distributed loads in accordance with an embodiment of the present patent application. Referring to FIG. 2, the system includes a local voltage regulator (U1) 201, a transconductance amplifier 203 (U0) connected with the local voltage regulator 201 and configured to drive the local voltage regulator (U1), and a transistor (Q1) 202.

The local voltage regulator 201 includes a first input, a second input, and an output. The transconductance amplifier 203 includes a first input, a second input and an output. The output of the transconductance amplifier 203 is connected to the first input of the local voltage regulator 201, and referred to as VCOMP. The first input of the local voltage regulator 201 is also connected to ground through a capacitor 207. The output of the local voltage regulator 201 is connected to gate of the transistor 202. The source or drain 206 of the transistor 202 is connected to a load 204, to the second input of the local voltage regulator 201, to the second input of the transconductance amplifier 203 through a first resistor 209 representing metal routing resistance, and to ground through a RC network.

In this embodiment, the load 204 is a digital core of a driver IC. The RC network includes the first resistor 209, at least one second resistor 211 representing the resistance of the ITO connections, and an external VDD capacitor 213 being connected in series. The first input of the transconductance amplifier 203 is connected to a reference voltage source Vref. In this embodiment, the reference voltage source is configured to make an adjustment to voltage at the first input of the transconductance amplifier 203 so that voltage at the source or the drain 206 of the transistor 202 is increased by a predetermined amount before a predictable current loading jump, and to cancel the adjustment after fluctuation of voltage at the source or the drain 206 of the transistor 202 caused by the adjustment is settled.

The transconductance amplifier 203 (U0) with its "high gain and low bandwidth" characteristics (typical voltage gain: 50~90 dB, bandwidth: 1~4 MHz), through the main feedback path 205 to VCOMP, is configured to determine the DC voltage level of VDD, which provides a settled stable VDD voltage.

The local voltage regulator 201 (U1) on the other hand having "low gain and high bandwidth" characteristics (typical voltage gain: 15~18 dB, bandwidth: 16~38 MHz) for regulating the local VDD voltage with regard to VCOMP, is capable of accomplishing much faster transient response time as compared with the conventional system.

The voltage gain of the local voltage regulator 201, configured as unity feedback, is tuned at approximately 10 times to ensure the PMOS power device Q1 (i.e. the transistor 202) is always turned on so as to response to the loading condition of the core logic (i.e. the digital core 204). The power Vdd metal routing will not affect this performance.

The local voltage regulator 201 may be located anywhere, being close to or far away from the transconductance amplifier 203. This allows putting the local voltage regulator 201 at the place where the most drastic loading condition exists.

Figure 3:
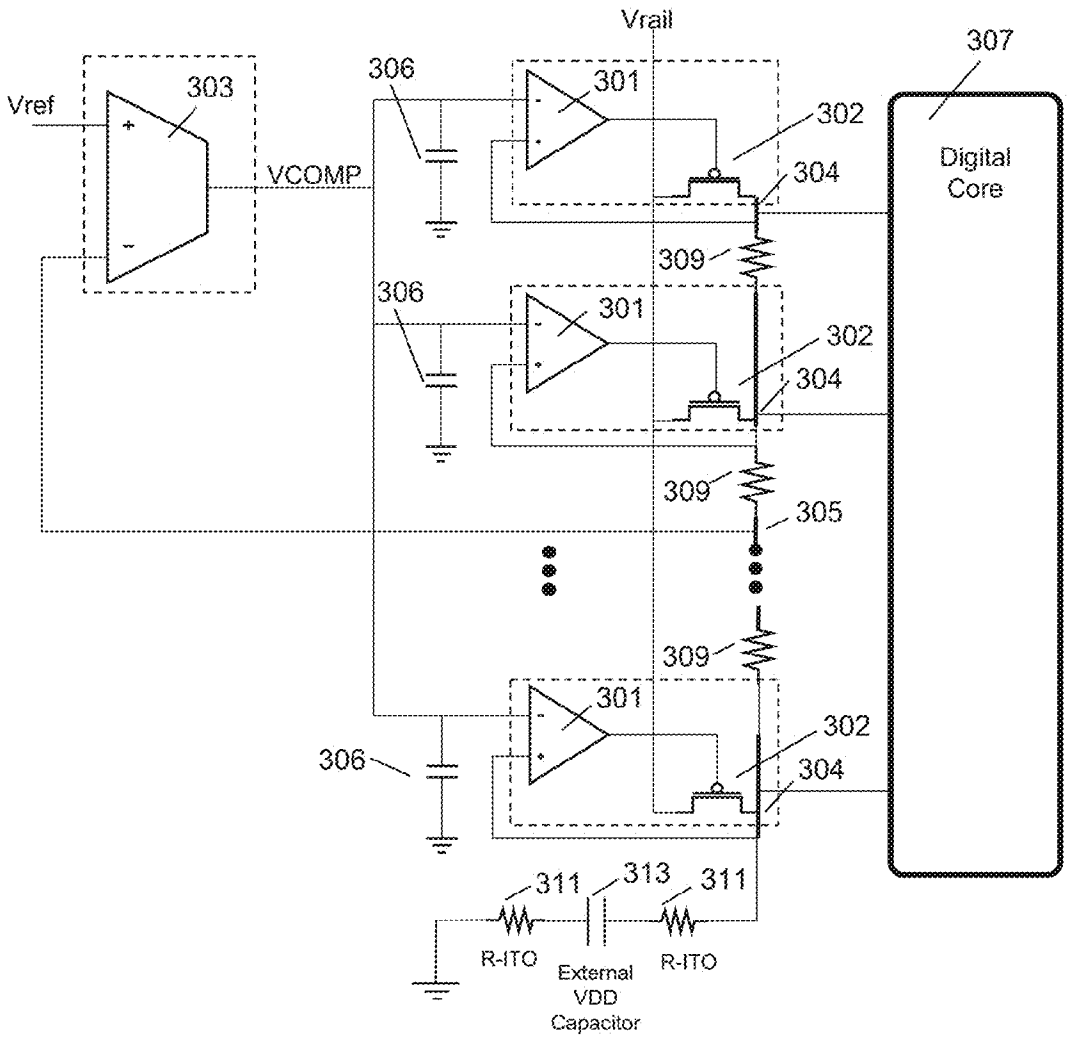
FIG. 3 is a schematic circuit diagram illustrating a system for providing on-chip voltage supply for distributed loads in accordance with another embodiment of the present patent application.

The basic architecture as illustrated in FIG. 2 may be extended to allow multiple local voltage regulators being driven by one main transconductance amplifier. FIG. 3 is a schematic circuit diagram illustrating a system for providing on-chip voltage supply for distributed loads in accordance with another embodiment of the present patent application. Referring to FIG. 3, the system includes a plurality of local voltage regulators 301, a transconductance amplifier 303 connected with the local voltage regulators 301 and configured to drive the local voltage regulators 301, and a plurality of transistors 302.

Each local voltage regulator 301 includes a first input, a second input, and an output. The transconductance amplifier 303 includes a first input, a second input and an output. The output of the transconductance amplifier 303 is connected to the first input of each local voltage regulators 301, and referred to as VCOMP. The first input of each local voltage regulator 301 is also connected to ground through a capacitor 306. The output of each local voltage regulator 301 is connected to gate of each transistor 302 correspondingly. The source or drain 304 of each transistor 302 is connected to a load 307, to the second input of the local voltage regulator 301, to each other through a plurality of first resistors 309 representing metal routing resistance, and to ground through a RC network. A tapping point 305 in the RC network is connected to the second input of the transconductance amplifier 303.

In this embodiment, the load 307 is a digital core of a driver IC. The RC network includes the first resistors 309, at least one second resistor 311 representing the resistance of the ITO connections, and an external VDD capacitor 313 being connected in series. The first input of the transconductance amplifier 303 is connected to a reference voltage source Vref. In this embodiment, the reference voltage source is configured to make an adjustment to voltage at the first input of the transconductance amplifier 303 so that voltage at the source or the drain 304 of each transistor 302 is increased by a predetermined amount before a predictable current loading jump, and to cancel the adjustment after fluctuation of voltage at the source or the drain 304 of each transistor 302 caused by the adjustment is settled.

In this embodiment, each local voltage regulator 301 is configured to handle the loading at its local point and thereby provide a much faster response to the local change of loading. Only one feedback tapping point 305 from VDD to VCOMP is needed for the "DC" VDD regulation. Due to the low-gain characteristic of the local voltage regulators 301, all of them are conducting during light loading (referring to FIG. 7), and they are of high-bandwidth (i.e. fast response). When abrupt rising step load happens (during mode changing for example), as all the local voltage regulators 301 are already conducting, they can response very fast to catch the load step and provide local "VDD" s so that the overall VDD will not dip much (bottoms at 1.2V, referring to FIG. 5).

Referring to FIG. 3, unutilized spaces inside digital core 307 are stuffed with filler cells. These filler cells can be capacitors connecting to VDD power and ground. Due to the long and narrow shape of the digital core 307, the ratio of the unused space is higher, compared with that of a square shape.

Figure 6:
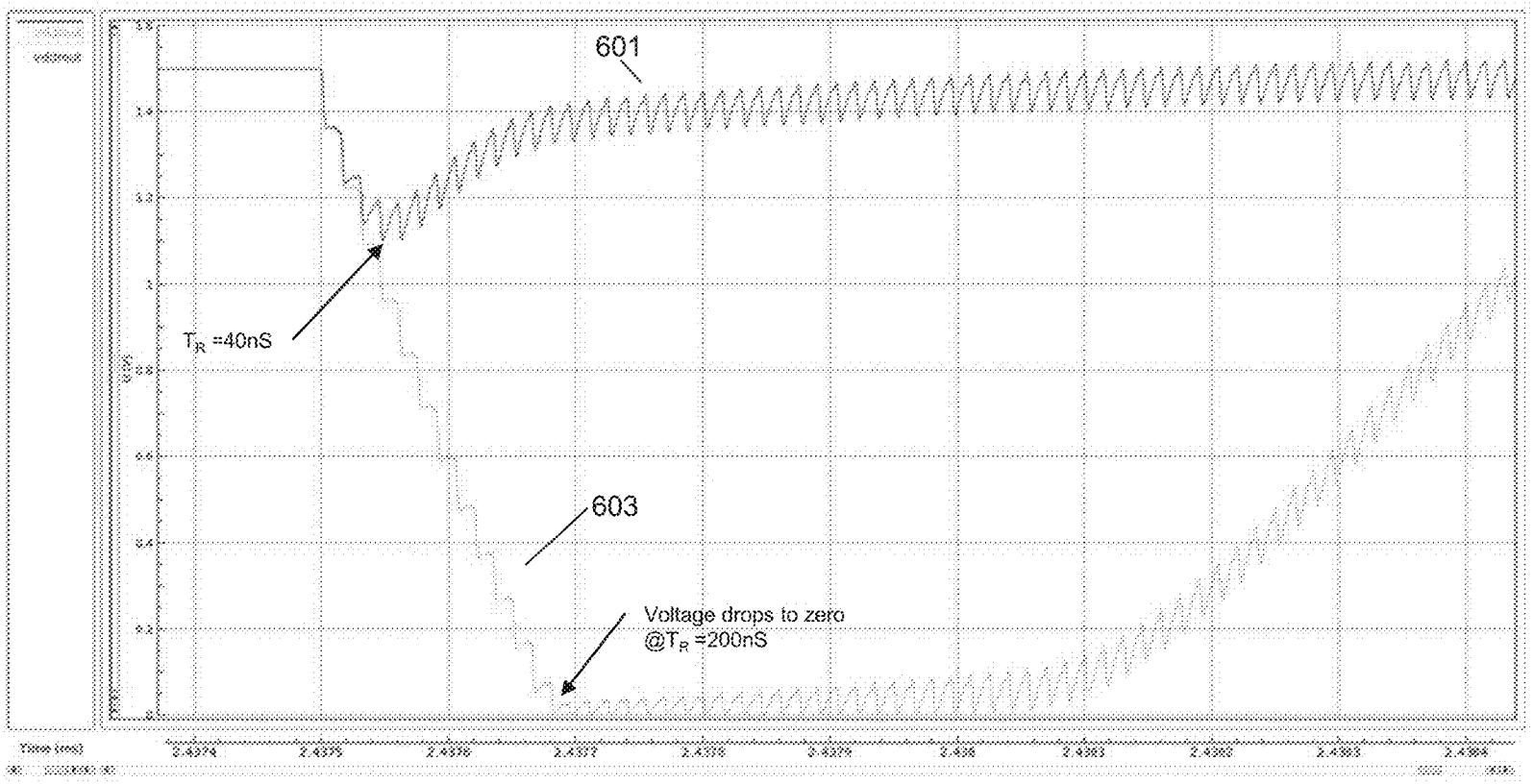
FIG. 6 shows simulation results of a system for providing on-chip voltage supply for distributed loads in accordance with an embodiment of the present application and a conventional system.

Referring to FIG. 6, which will be described in more detail hereafter, with a certain amount of filler cells, for example with 1~5 nF capacitance, the system is stable without the use of an external VDD capacitor. The VDD drops from 1.5V to 1.1V and is recovered in around 0.1 micro-second.

Figure 4:
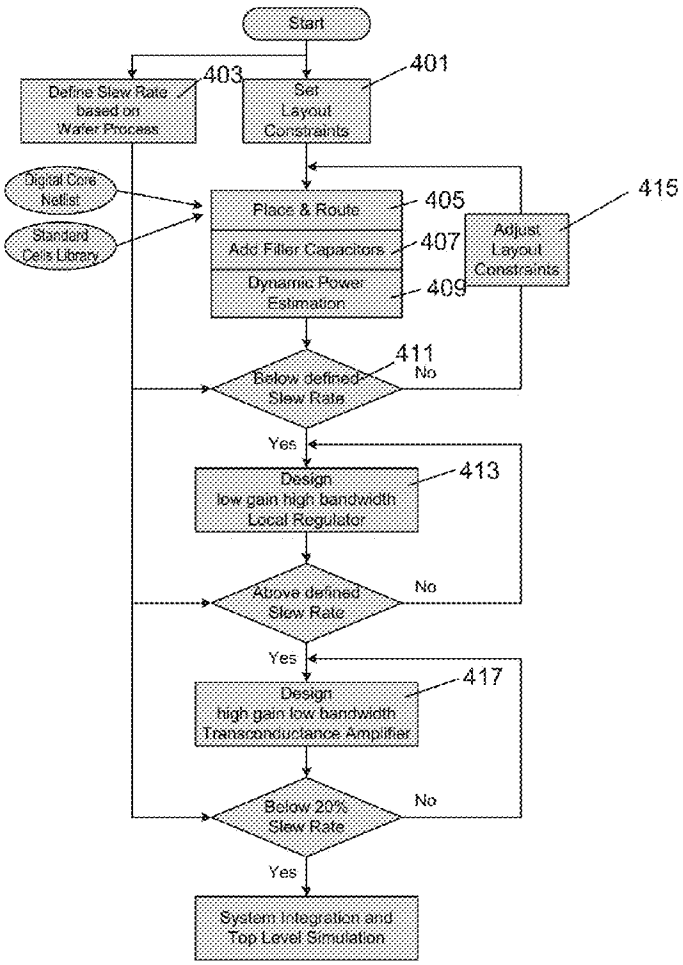
FIG. 4 is a flow chart illustrating a method for designing a system for providing on-chip voltage supply for distributed loads in accordance with yet another embodiment of the present patent application.

FIG. 4 is a flow chart illustrating a method for designing a system for providing on-chip voltage supply for distributed loads in accordance with yet another embodiment of the present patent application. Referring to FIG. 4, the method includes:

1. preparing initial inputs, which includes: digital core net-list which describes the digital circuit, readily available standard cells library which contains the fundamental building blocks for digital circuits, layout constraints which can be physical constraints, electrical constraints and timing constraints (step 401); an appropriate power rail voltage slew rate (the rate of voltage fluctuation on the power rails) defined based on selected wafer process (step 403);
2. placing and routing standard cells using appropriate EDA tools (step 405); this process generates the layout of the digital core using standard cells building blocks;
3. adding filler capacitors within the digital core to reduce power rails voltage fluctuations (step 407);
4. carrying out dynamic power estimation using appropriate EDA tool (step 409); this will provide an insight of the current profile and voltage fluctuation at each control node (i.e. feedback tapping point of each local voltage regulator);
5. checking whether power rail slew rate at each control node is lower than the defined value (step 411); if yes, go to designing the low gain high bandwidth local voltage regulator (step 413); if not, adjust layout constraints (step 415) and go back to step 405;
6. designing the local voltage regulator to support the defined slew rate (step 413); in other words, the local voltage regulator should response fast enough so that the voltage drop at each control node is within standard cells acceptable level; and
7. designing the transconductance amplifier to have a slew rate below 20% of the defined slew rate (step 417); this will allow the transconductance amplifier to only response to averaged-out power rail voltage (rather than instantaneous power rail voltage fluctuations).

It is noted that in this embodiment, the combination of a relatively slow response transconductance amplifier plus relatively fast response local voltage regulators can ensure a stable power supply (i.e. without overshoot or oscillations).

Figure 5:
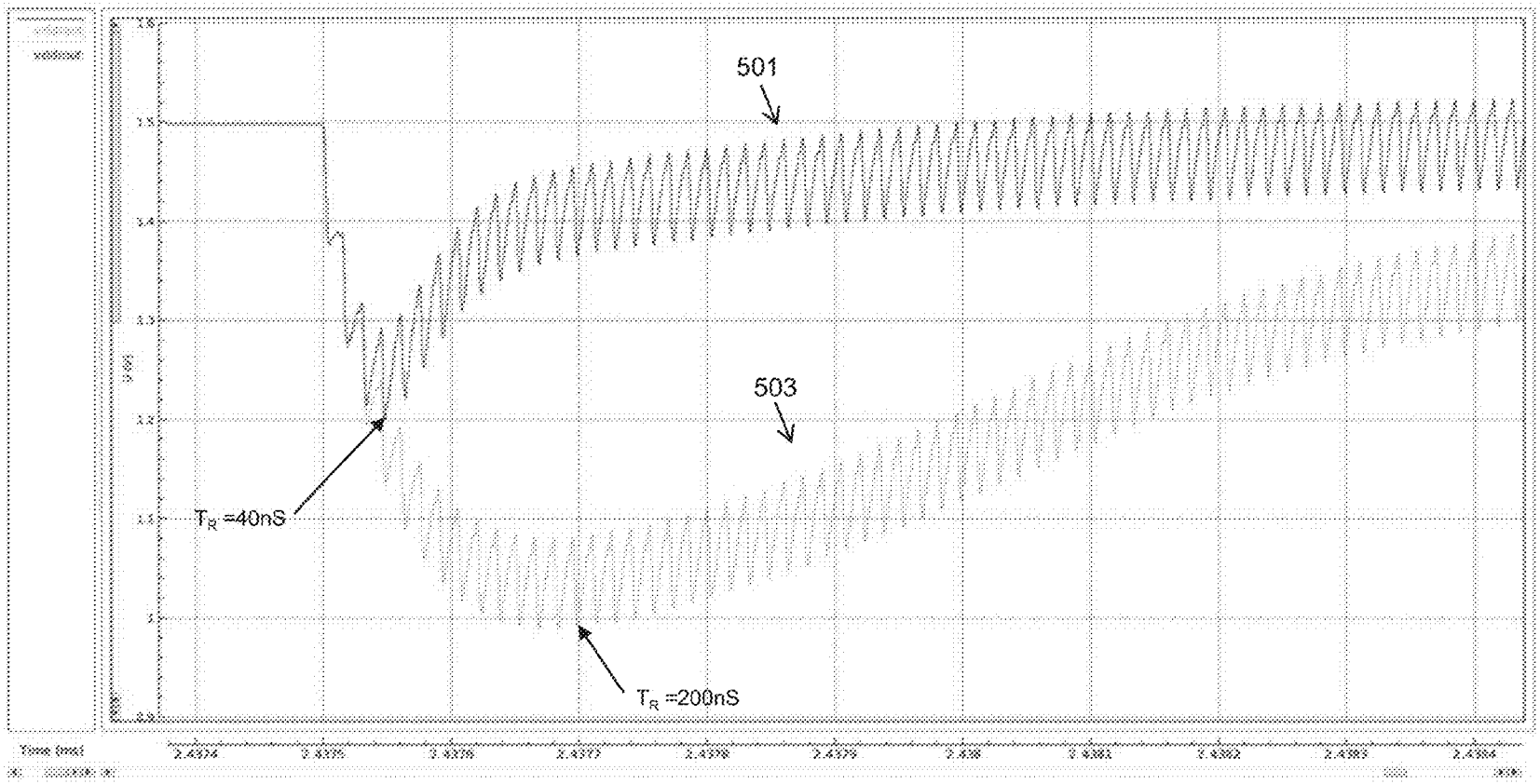
FIG. 5 shows simulation results of a system for providing on-chip voltage supply for distributed loads in accordance with an embodiment of the present application and a conventional system.

FIG. 5 shows simulation results of a system for providing on-chip voltage supply for distributed loads in accordance with an embodiment of the present application and a conventional system. Referring to FIG. 5, the VDD performance is shown for the system of this embodiment (curve 501) and the conventional system (curve 503). In the simulation, the loading condition is 0 to 350 mA pulsing load at period of 15 nS. The filler capacitance is 5 nF, VDD output capacitance is 2.2 uF.

FIG. 6 shows simulation results of a system for providing on-chip voltage supply for distributed loads in accordance with an embodiment of the present application and a conventional system. Referring to FIG. 6, the VDD performance is shown for the system of this embodiment (curve 601) and the conventional system (curve 603). In the simulation, the loading condition is 0 to 350 mA pulsing load at period of 15 nS. The filler capacitance is 5 nF. There is no VDD output capacitance in this simulation.

Figure 7:
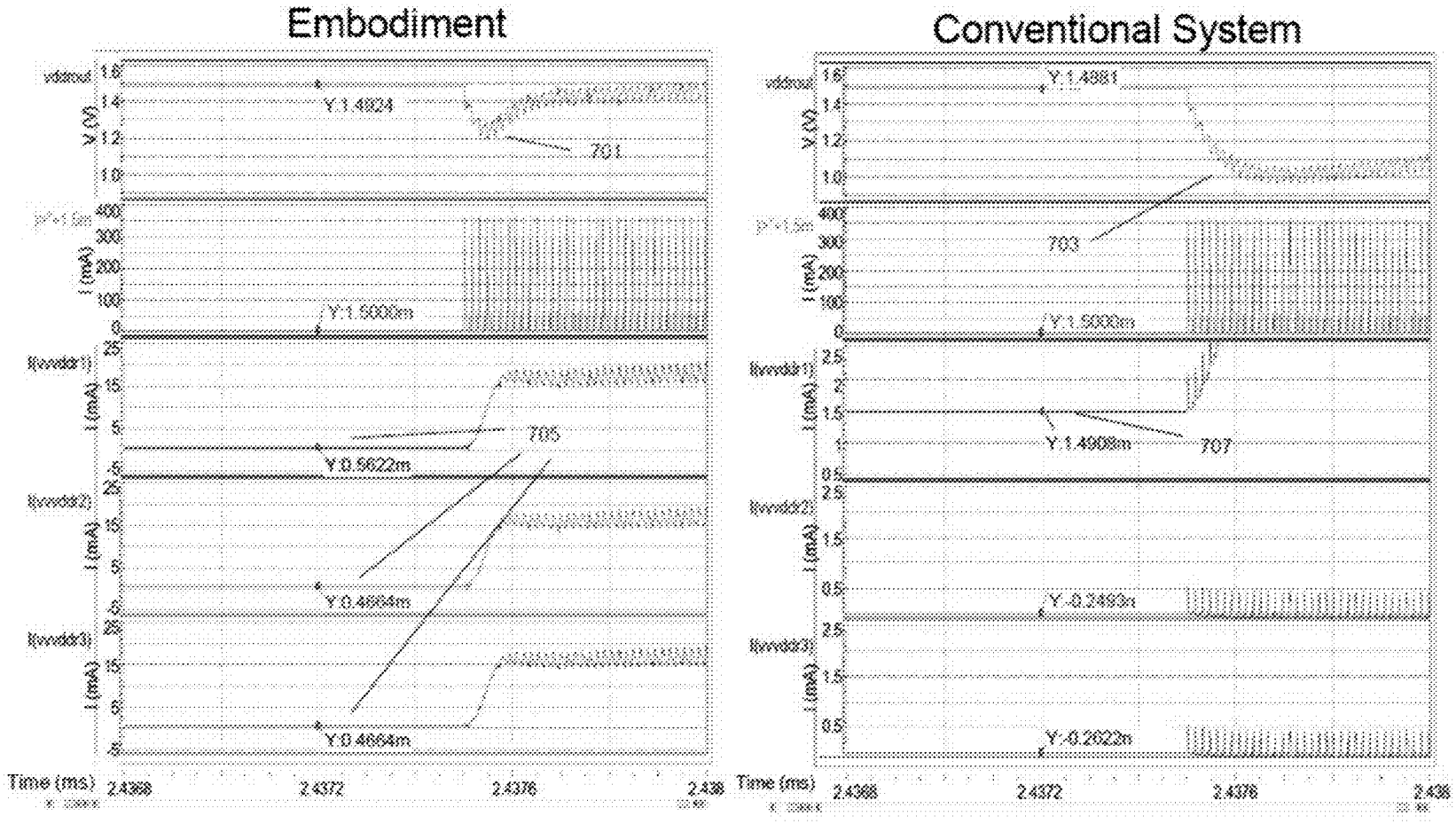
FIG. 7 shows simulation results of a system for providing on-chip voltage supply for distributed loads in accordance with an embodiment of the present application and a conventional system.

FIG. 7 shows simulation results of a system for providing on-chip voltage supply for distributed loads in accordance with an embodiment of the present application and a conventional system. In the simulation, the loading condition is 0 to 350 mA pulsing load at period of 15 nS. The filler capacitance is 5 nF, VDD output capacitance is 2.2 uF. Referring to FIG. 7, in this embodiment, at point 701, when abrupt rising step load happens, as all the local voltage regulators 301 are already conducting, they can response very fast to catch the load step and provide local "VDD" s and thus the overall "VDD" does not dip much. In comparison, referring to point 703, with the conventional system, when abrupt rising step load happens, long time is needed for the shut-off regulators turning back on to catch the load step, and thus severe "VDD" voltage dip will happen.

Referring to point 705, in this embodiment, due to the low-gain characteristic of the local voltage regulators 301, all of them are conducting during light loading. In comparison, with the conventional system, referring to point 707, due to the unbalance behavior and the voltage regulators' high gain characteristics, only the one regulator at highest voltage regulation point will be taking-over and conducting, while all others are shutting off.

Figure 8:
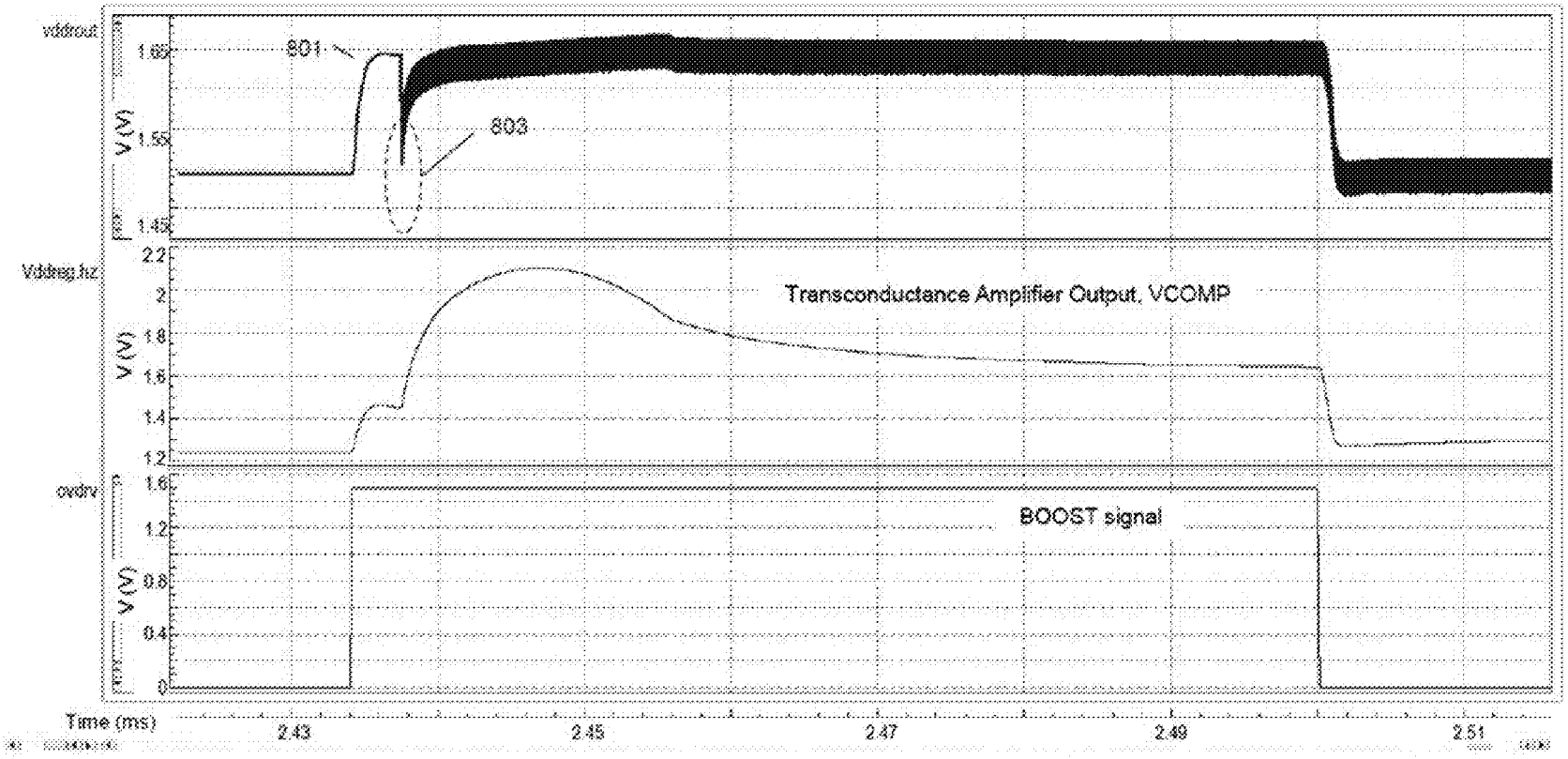
FIG. 8 shows simulation results of a system for providing on-chip voltage supply for distributed loads in accordance with an embodiment of the present application.

FIG. 8 shows simulation results of a system for providing on-chip voltage supply for distributed loads in accordance with an embodiment of the present application. In the simulation, the loading condition is 0 to 175 mA pulsing load at period of 15 nS. The filler capacitance is 5 nF, VDD output capacitance is 2.2 uF. In this embodiment, the Vref voltage is adjusted so that a control signal BOOST boosts up the target VDD voltage level from 1.5V to 1.65V. Such mode, which is also referred to as the over-drive mode, is enabled before a predictable current loading jump, and disabled after the VDD voltage fluctuation caused by the jump is settled. The VDD voltage dip bottoms at 1.5V voltage level which allows safe margin for the digital core operation. Referring to FIG. 8, BOOST signal is high about 3 us before the loading current's sudden increase and lasts for 63 us after the sudden increase. At point 801, before the transient load occurs, the over-drive mode is enabled to boost the output VDD voltage from 1.50V to 1.65V. At point 803, after the transient load occurs, the dipped VDD voltage will be at a higher level to allow safe margin for digital core operation.

Figure 9:
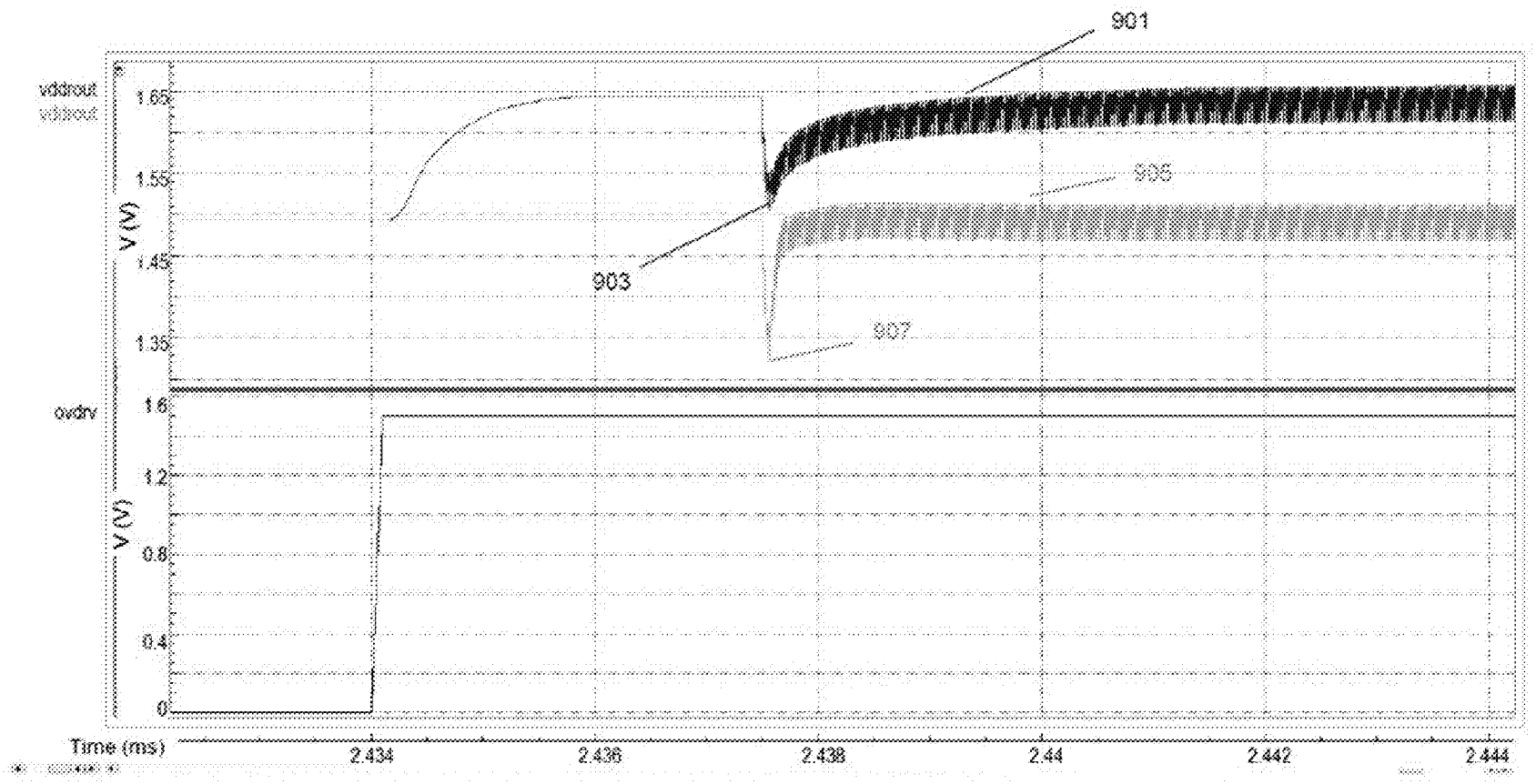
FIG. 9 shows simulation results of a system for providing on-chip voltage supply for distributed loads in accordance with an embodiment of the present application, with an increase in the voltage at the source or the drain of the transistor by a predetermined amount before a predictable current loading jump, and a system without this predetermined amount of voltage increase.

FIG. 9 shows simulation results of a system for providing on-chip voltage supply for distributed loads in accordance with an embodiment of the present application and a conventional system. In the simulation, the loading condition is 0 to 175 mA pulsing load at period of 15 nS. The filler capacitance is 5 nF, VDD output capacitance is 2.2 uF. Referring to FIG. 9, in curve 901 for the system of the embodiment with the over-drive feature enabled, at point 903, the over-drive feature boosts output VDD voltage to a higher level before transient load occurs, so that the lowest point of VDD will maintain above 1.35V as required. In curve 905, without the over-drive feature enabled, at point 907, VDD gets below 1.35V.

The system for providing on-chip fast response voltage supply for distributed loads provided by the above embodiments includes an integrated circuit (IC) having a transconductance amplifier and local voltage regulator apply on mobile display devices. The system has ultra-fast response, is easily scalable to support widely distributed layout placement, and can be used to effectively tackle the increasingly drastic loading profile at different points of the supply rail of the more power demanding digital core regardless of the physical layout shape. With this topology and its ultra-fast response, a feasible amount of on-chip filler-cells embedded in the digital core are good enough for stability and decoupling. Therefore, the scheme provided by the above embodiments can eliminate the use of external output capacitors and highly resistive ITOs.

While the present patent application has been shown and described with particular references to a number of embodiments thereof, it should be noted that various other changes or modifications may be made without departing from the scope of the present invention.

What is claimed is:

1. A system for providing on-chip voltage supply, the system comprising:

a plurality of local voltage regulators, each local voltage regulator comprising a first input, a second input, and an output;

a transconductance amplifier connected with the local voltage regulators and configured to drive the local voltage regulators, the transconductance amplifier comprising a first input, a second input and an output;

a reference voltage source; and a plurality of transistors; wherein:

the output of the transconductance amplifier is connected to the first input of each local voltage regulators;

the first input of the transconductance amplifier is connected to the reference voltage source;

the first input of each local voltage regulator is connected to ground through a first capacitor;

the output of each local voltage regulator is connected to gate of each transistor correspondingly;

source or drain of each transistor is connected to a load, to the second input of the local voltage regulator, to each other through a plurality of first resistors representing metal routing resistance, and to ground through a RC network; and a tapping point in the RC network is connected to the second input of the transconductance amplifier;

wherein the reference voltage source is configured to make an adjustment to voltage at the first input of the transconductance amplifier so that voltage at the source or the drain of each transistor is increased by a predetermined amount before a predictable current loading jump, and to cancel the adjustment after fluctuation of voltage at the source or the drain of each transistor caused by the adjustment is settled.

2. The system of claim 1, wherein the load is a digital core of a driver IC.

3. The system of claim 1, wherein the RC network comprises the first resistors, at least one second resistor representing resistance of ITO connections, and a second capacitor being connected in series.

4. The system of claim 1, wherein the reference voltage source is a steady DC voltage source.

5. The system of claim 1, wherein the transconductance amplifier has a voltage gain in the range of 50~90 dB and a bandwidth in the range of 1~4 MHz.

6. The system of claim 1, wherein each local voltage regulator has a voltage gain in the range of 15~18 dB and a bandwidth in the range of 16~38 MHz.

7. The system of claim 1, wherein the transistors are PMOS transistors.

8. The system of claim 1, wherein a control signal BOOST is used to boost up the voltage at the source or the drain of each transistor.

9. The system of claim 8, wherein the BOOST signal is high for a first preset duration before the predictable current loading jump and lasts for a second preset duration after the predictable current loading jump.

10. The system of claim 1, wherein the transconductance amplifier is directly connected with the local voltage regulators.

* * * * *